US008622258B2

(12) United States Patent
Weissbrod

(10) Patent No.: US 8,622,258 B2
(45) Date of Patent: Jan. 7, 2014

(54) CONTAINER HAVING A HANDLE ASSEMBLY

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 90 days.

(21) Appl. No.: 13/280,935

(22) Filed: Oct. 25, 2011

(65) Prior Publication Data

US 2013/0098948 A1 Apr. 25, 2013

(51) Int. Cl.
*B65D 47/00* (2006.01)

(52) U.S. Cl.
USPC ..... 222/502; 222/561; 222/465.1; 493/88; 493/226

(58) Field of Classification Search
USPC ..... 222/181.3, 502, 561, 180, 181.1, 181.2, 222/465.1, 469; 229/220; 383/906; 493/52, 493/88, 186, 226, 909, 926
See application file for complete search history.

(56) References Cited

U.S. PATENT DOCUMENTS

| | | | | |
|---|---|---|---|---|
| 2,387,640 | A | 10/1945 | Bouchelle | |
| 2,419,182 | A | 4/1947 | Wells | |
| 3,000,409 | A * | 9/1961 | Thomasco | 141/373 |
| 3,040,953 | A * | 6/1962 | Tindall | 229/220 |
| 3,799,409 | A | 3/1974 | Goerke | |
| 4,081,128 | A * | 3/1978 | O'Neill | 229/220 |
| 4,270,677 | A | 6/1981 | Schmidt | |
| 4,449,649 | A * | 5/1984 | Flannigan | 222/181.3 |
| 4,759,473 | A * | 7/1988 | Derby et al. | 222/105 |
| 4,991,979 | A * | 2/1991 | Strand et al. | 383/25 |
| 5,396,998 | A | 3/1995 | Chaisson | |
| 6,364,160 | B1 * | 4/2002 | Kim | 222/1 |
| 6,447,165 | B1 | 9/2002 | Grewe | |
| 6,857,560 | B2 | 2/2005 | Kutner | |
| D519,847 | S | 5/2006 | Lucas et al. | |
| 7,040,528 | B2 * | 5/2006 | Hengami | 229/117.3 |
| 7,503,475 | B2 * | 3/2009 | McGowan | 229/220 |

(Continued)

FOREIGN PATENT DOCUMENTS

| | | |
|---|---|---|
| DE | 7530594 U | 10/1976 |
| DE | 10325175 A1 | 8/2004 |

(Continued)

OTHER PUBLICATIONS

International Search Report for corresponding application PCT/IB2012/002141, dated Jan. 23, 2013.

(Continued)

*Primary Examiner* — Kevin P Shaver
*Assistant Examiner* — Patrick M Buechner
(74) *Attorney, Agent, or Firm* — Hahn Loeser & Parks LLP

(57) ABSTRACT

A container includes a body, a panel, and a handle assembly. The body defines a closed volume of the container and further includes at least two opposing walls having a width and longitudinally extending between a first end and a second end of the body. The panel includes an inner surface fixedly secured to the panel to the body. The handle assembly is at least partially disposed within a space created between the panel and the body, the handle assembly having a dispensing aperture, and the handle assembly being slidable within the space. A method of forming a container and a method of dispensing a container are also discussed.

24 Claims, 11 Drawing Sheets

(56) References Cited

U.S. PATENT DOCUMENTS

| | | | | |
|---|---|---|---|---|
| 8,029,192 | B2 | 10/2011 | Weissbrod | |
| 2004/0131285 | A1 | 7/2004 | Shepard et al. | |
| 2010/0129009 | A1 | 5/2010 | Weissbrod | |
| 2011/0101040 | A1 * | 5/2011 | Weissbrod | 222/561 |

FOREIGN PATENT DOCUMENTS

| | | | |
|---|---|---|---|
| DE | 102007036903 | A1 | 8/2008 |
| EP | 577163 | A1 | 1/1994 |
| FR | 2802189 | A1 | 6/2001 |
| FR | 2929247 | A1 | 10/2009 |
| GB | 2039842 | | 8/1980 |
| WO | 9202437 | | 2/1992 |
| WO | 2005051790 | | 6/2005 |

OTHER PUBLICATIONS

Written Opinion of International Search Authority for corresponding application PCT/IB2012/002141, dated Jan. 23, 2013.

* cited by examiner

CONTAINER HAVING A HANDLE ASSEMBLY

TECHNICAL FIELD

The invention described herein relates generally to containers having a handle assembly and methods of making and using the same.

BACKGROUND OF THE DISCLOSURE

Countless products are packaged and shipped to end-users in this country and around the globe every day. Many materials, e.g., flux material used in welding, are packaged in containers and then shipped to customers. In some circumstances, handling the container, opening the container, controlling flow of material dispensing from the container, and resealing the container is difficult and may result in damaging the container and/or spilling some material.

In view of the foregoing problems and shortcomings of handling the containers and controlling the material, the present application describes containers having a handle assembly to overcome these shortcomings.

SUMMARY OF THE DISCLOSURE

In accordance with the present invention, there is provided a container that includes a body, at least one panel, and a handle assembly. The body includes a first end, and a second end, the body defining a closed volume of the container and further including at least two opposing walls having a width and longitudinally extending between the first end and the second end. The at least one panel includes an outer surface, an inner surface, a width and a length, and a securing means which fixedly secures the at least one panel to the body. In addition, the handle assembly is at least partially disposed within a space created between the at least one panel and the body, the handle assembly being slidable within the space, and the body, the at least one panel and the handle assembly each having an alignable dispensing means.

Also within the scope of the invention is another container having a first end, and a second end, the body defining a closed volume of the container and further including at least two opposing walls longitudinally extending between the first end and the second end. The container includes a panel having an inner surface and a securing means which fixedly secures the panel to the body. In addition, the container includes a handle assembly having a first handle and a second handle at opposing ends, the handle assembly at least partially disposed within a space created between the panel and the body, the handle assembly having a dispensing aperture, the handle assembly being slidable within the space, and a means for preventing at least one handle from passing into the space between the panel and the body. Further, the container includes a means for dispensing material from the container, including dispensing material through a body aperture, a panel aperture, and a handle assembly dispensing aperture, wherein the means for dispensing material from the container includes at least one of the following: at least one aperture is at least partially preformed before a material at least partially fills the container and at least one aperture is formed after the material at least partially fills the container.

Also within the scope of the invention is a method of forming a container. The method includes forming a body having a first end, and a second end and further including at least two opposing walls longitudinally extending between the first end and the second end, the at least two opposing walls joined longitudinally, and joined laterally at least at the second end. In addition, the method includes forming a handle assembly having two ends and a dispensing aperture and forming a panel having an outer surface, an inner surface, a width, and a length. The method also includes fixedly securing the panel to the body with a securing means to form a space between the panel and the body, where the handle assembly is at least partially disposed within the space.

Also within the scope of the invention is a method of dispensing material. The method of dispensing material includes obtaining a container having a body with a body aperture where the body is capable of holding a volume containing a material, a handle assembly having at least two ends and a dispensing aperture therebetween, and a panel having a panel aperture fixedly secured to the body by a securing means to form a space between the panel and the body, and where the handle assembly is at least partially disposed within the space. In addition, the method includes holding the container by the handle assembly and moving at least one end of the handle assembly to move the dispensing aperture relative to at least the body aperture. The method also includes adjustably dispensing the material from the container by at least partially aligning the dispensing aperture with at least the body aperture.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE DRAWINGS

Figure 1:
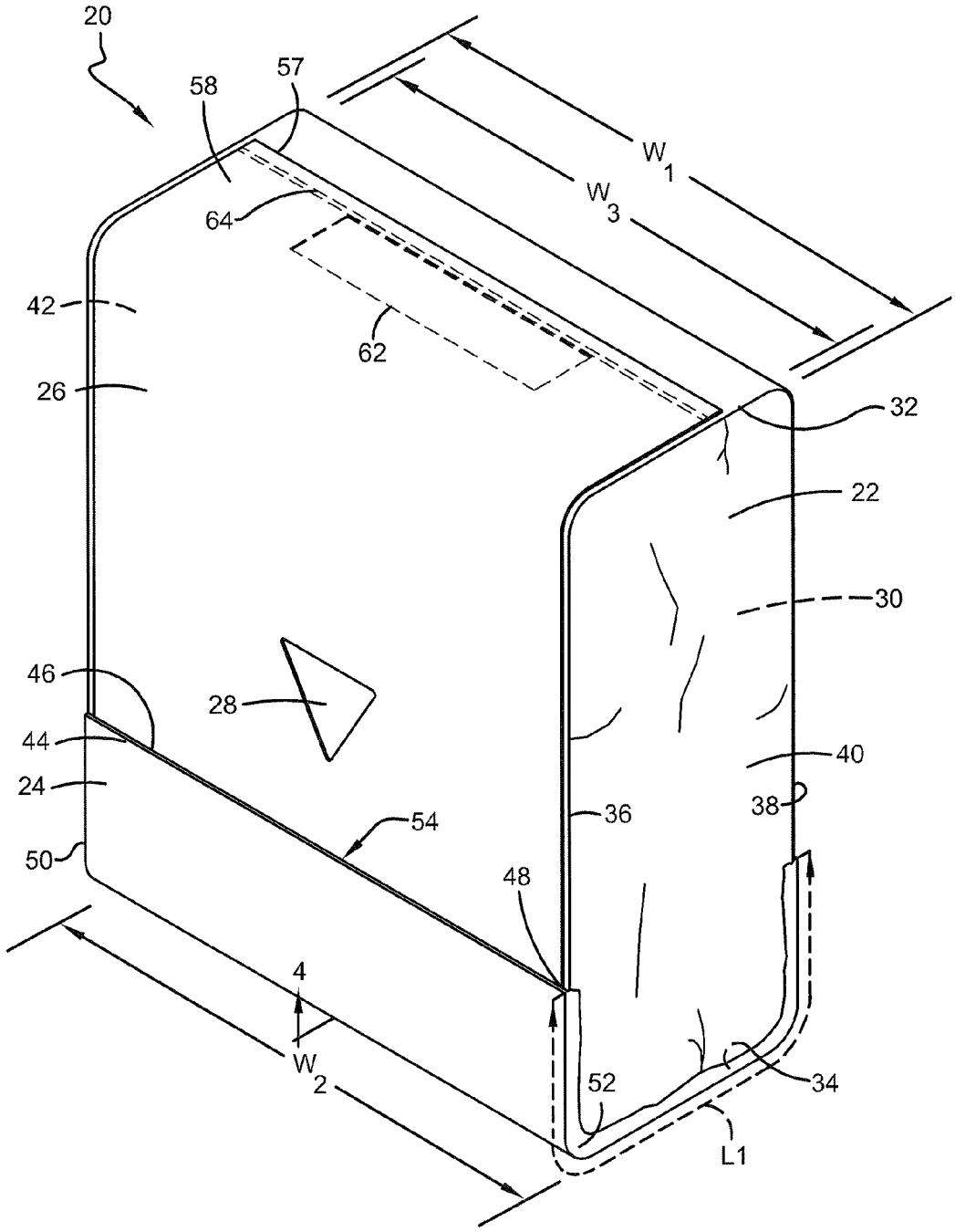
FIG. 1 is a top side perspective view of a container having a handle assembly partially disposed between a body and a panel of the container.
Figure 2:
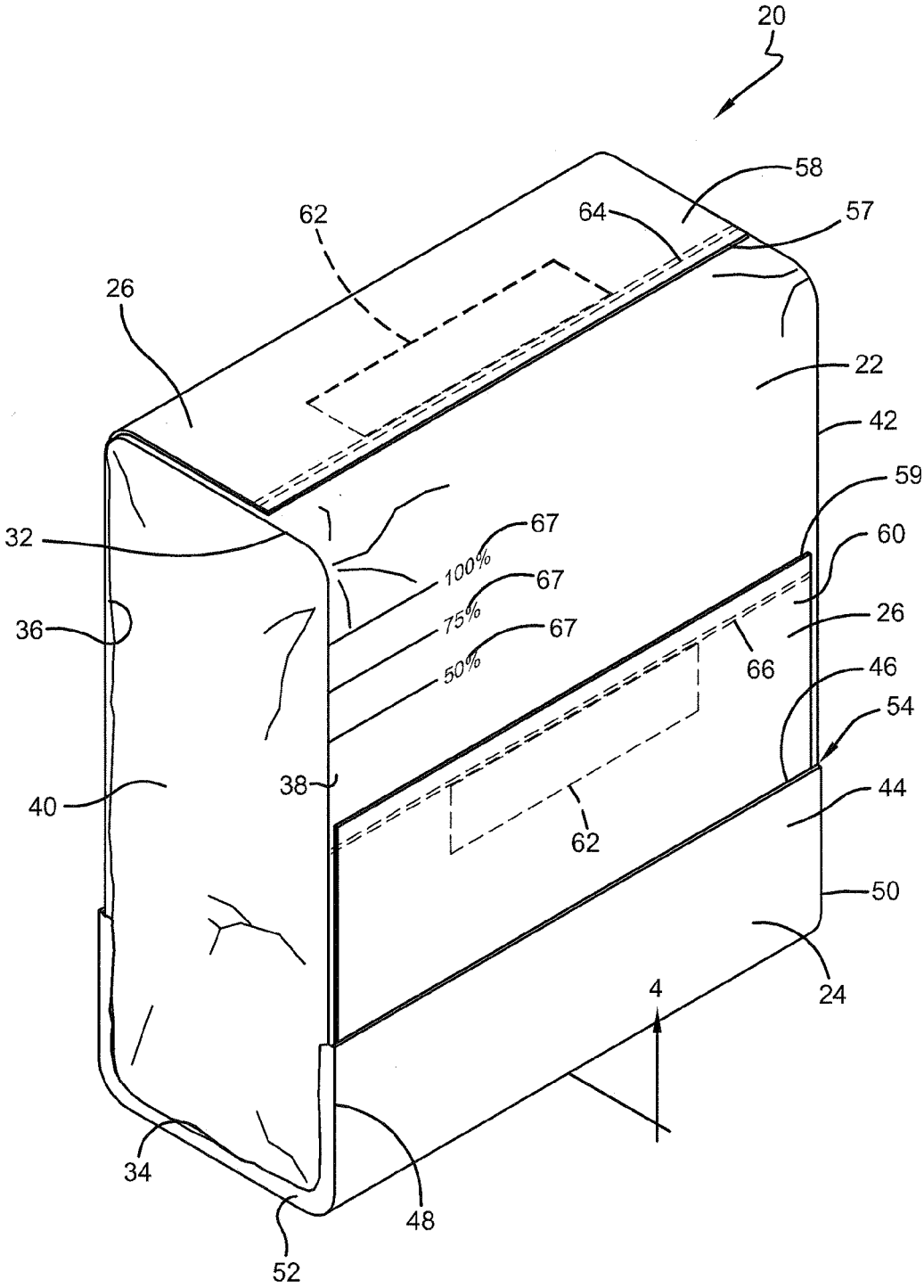
FIG. 2 is another top side perspective view of the container illustrated in FIG. 1, illustrating the opposing side of the container.
Figure 3:
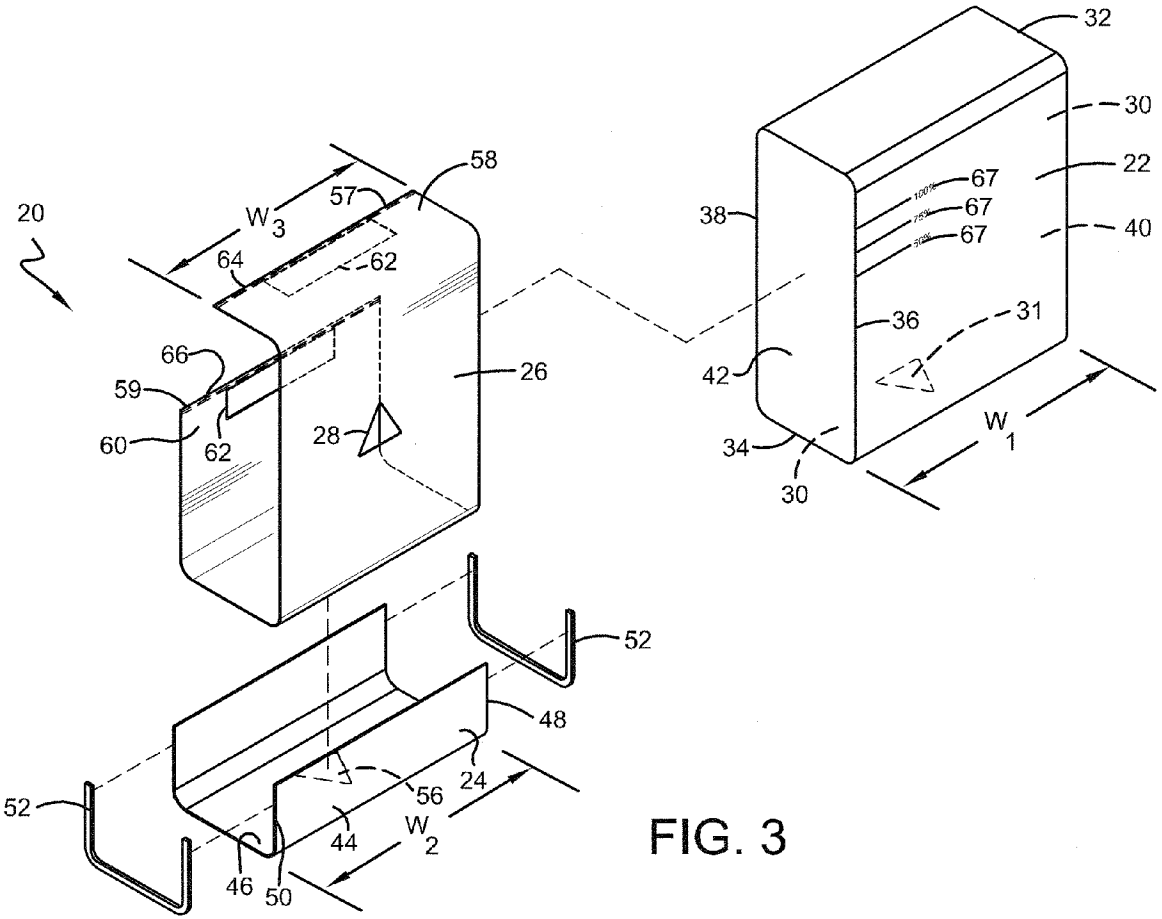
FIG. 3 is an exploded assembly view of the container illustrated in FIGS. 1-2.

Referring now to the drawings wherein the showings are for purposes of illustrating embodiments of the invention only and not for purposes of limiting the same, FIGS. 1-2, show container 20 having body 22, panel 24 fixedly secured to body 22, and handle assembly 26 having at least one dispensing aperture 28. FIG. 3 shows an exploded assembly view of container 20 illustrated in FIGS. 1-2. A container is defined to mean any size bag, sack, box, carton, or tote, for example, made from materials discussed below and configured to hold, store, and/or transport a material. In the illustrated embodiments, handle assembly 26 is partially disposed and slidable within space 54 formed between body 22 and panel 24. Container 20 may be used to facilitate handling, storage, and dispensation of material (shown in FIGS. 4A-4B) stored in volume 30 of body 22, e.g., a closed volume. Handle assembly 26 facilitates handling and carrying of container 20 while the combination of body 22, panel 24, and handle assembly 26 facilitates adjustable dispensation of material from container 20. Materials stored in container 20 may include, but are not limited to, powdered or granular flux material for use in submerged arc welding or other welding processes.

In construction, body 22, panel 24, and handle assembly 26 may each be formed of at least one of the following materials, including but not limited to single layer or multi-layer paper, plastic, foil plastic laminate, and textile. Body 22, panel 24, and handle assembly 26 may be constructed from the same or different material depending on the requirements of the application. The selection of the materials of construction are predicated upon design criteria of the application and include non-limiting factors tear strength, tightness of wear, puncture resistance, etc., to carry and/or retain a material in container 20. In one embodiment, one material is a heat-sealable material. A heat-sealable material is defined to mean a material which may be bonded to itself or another material by heat and pressure to form a seal or closure, for example a heat seal or closure against air, moisture, or tampering. The heat seal may be formed by a heat sealing process known in the art, wherein the heat-sealable materials are subjected to temperature and pressure sufficient to form a heat seal. In one example, the temperature may be about 140° C. and the pressure may be about 50 pounds per square inch of seal band surface when forming a heat seal in low density polyethylene.

The heat-sealable material in FIGS. 1-2 may be a thermoplastic material, but it is envisioned that body 22, panel 24, and handle assembly 26 may be constructed of any heat-sealable material known in the art. More specifically, the heat-sealable material may be low density polyethylene. However, it is further envisioned that body 22, panel 24, and handle assembly 26 may each be constructed of different heat-sealable materials, e.g., body 22 and panel 24 may be constructed of one heat-sealable material and handle assembly 26 may be constructed of a different heat-sealable material. Alternatively, the body may comprise a laminate of at least a heat-sealable material and a second material. For example, in an application requiring a moisture impermeable container, the body may comprise an exterior plastic layer which may be optionally heat-sealable, an intermediate metal foil layer which may be moisture impermeable, and an interior heat-sealable material. The body, the panel, and/or the handle assembly may be made of paper and plastic. For example, the handle assembly may be made of paper having ends made of plastic that are connected to the body with an adhesive or are heat sealed to the body. The body, the panel, and the handle assembly may be formed from at least one of the following: any formable plastic material known in the art, including polyethylene, any formable paper material known in the art, including cardboard and/or kraft paper, any formable textile material known in the art, including canvas, and any formable foil plastic laminate material known in the art. A formable material is defined to mean a material that can be shaped into a part or component of the containers claimed herein.

Referring again to FIGS. 1-3, body 22 may be formed from at least one piece of material and may include an optional body aperture 31. For example, body 22 may be a unitary structure or a structure made from two or more parts that are attached together by means such as an adhesive, a stitch, or a heat seal. In the illustrated embodiment, body 22 may further include first end 32, second end 34, and at least two opposing walls, including first wall 36 and second wall 38, where each wall has width W1. First wall 36 and second wall 38 longitudinally extend between first end 32 and second end 34 and are joined, e.g., laterally, at first end 32 and second end 34.

Further in FIGS. 1-3, body 22 optionally includes first sidewall 40 and second sidewall 42 that longitudinally extend between first end 32 and second end 34. Alternatively, first sidewall and second sidewall are gusseted sidewalls. In one aspect of the invention, the body may not include sidewalls, therefore, the first wall and the second wall may be longitudinally joined to each other by the longitudinal edges of each wall, e.g., joined with a heat seal or an adhesive, including but not limited to a hot melt glue or a water soluble cold glue. In another optional aspect of the invention, the body includes an inlet used to fill the container with material. When the container does not include an inlet, the body is sealed after filling the container with a material.

In FIGS. 1-3, panel 24 follows a profile of body 22 and includes outer surface 44, inner surface 46, first end 48, and second end 50. Panel 24 preferably has a curvilinear length L1 that extends around the profile of body 22, including second end 34. Panel 24 extends longitudinally toward first end 32 adjacent to first wall 36 and second wall 38. Panel 24 has a width W2 that spans at least a portion of width W1, e.g., width W2 can be one-half, two-thirds, or three-fourths of width W1 (see FIG. 8) or equal to width W1. The parts of the panel that are positioned adjacent to the first wall and the second wall of the body can be equal or unequal in longitudinal length. In another embodiment, the panel does not extend adjacent to the first wall and/or the second wall, e.g., the panel may only be adjacent to one plane. Alternatively, the panel can extend to the sidewalls. For example, the panel can have the shape of a cap that is securedly attached to the sidewalls of the body.

Further in FIGS. 1-2, panel 24 is fixedly secured to body 22 by securing means 52 in at least two locations and forms space 54 between body 22 and panel 24. The securing means serves a function of containing handle assembly 26 within space 54. Securing means 52 may include at least one of the following: adhesives, stitches, snaps, heat seals, edge-bonds, and any of a variety of other suitable mechanical fastening arrangements. For example, in FIGS. 1-2, panel 24 is fixedly secured to second end 34 and walls 36 and 38 of body 22 by a hot melt glue applied at least between first end 48 and second end 50 of panel 24 and body 22, forming space 54 that extends at least a portion of width W2 of panel 24. The first end and the second end of the panel may be at least partially secured to the second end and/or the first and second walls of the body. Alternatively, the panel may be fixedly secured to the body in at least two locations, wherein at least one location is not an end of the panel. In addition, the panel may be releasably connected on one or both ends, therefore, the handle assembly can be releasably inserted in the space between the body and the panel for use in one container and later removed from the container and reused in another container.

The panel may have an alternative shape or side profile, e.g., flat or planar, and is be fixedly secured to at least one part of the body, including but not limited to the first wall, the second wall, the first end, the second end, the first sidewall, and the second sidewall. For example, the panel may be flat and fixedly secured to the first wall of the body by a securing means in at least two locations, forming a space between the panel and the body where the handle assembly is at least partially disposed. Alternatively, the panel may have another shape, including but not limited to a square shape, an hour glass shape, or a combination of shapes known in the art.

Illustrated in FIG. 3, panel 24 optionally includes panel aperture 56 that may be substantially aligned with body aperture 31 when panel 24 is fixedly secured to body 22. In other words, if the apertures are similar in size and shape, the apertures may be in a mirrored position relative to one another when the panel is secured to the body. The body aperture and the panel aperture may be at least partially aligned. Alternatively, the panel may include a perforated zone or may include printing or graphics, e.g., "puncture here," that can be used by a person to facilitate forming an aperture in the panel.

Referring again to FIGS. 1-3, handle assembly 26 is at least partially disposed and slidably received by space 54 between body 22 and panel 24 and longitudinally extends adjacent to opposing sides of body 22. Handle assembly 26 at least partially conforms to a shape of the space 54 between body 22 and panel 24 when it is disposed and slides within space 54.

Further illustrated in FIGS. 1-3, handle assembly 26 includes opposing ends, and optionally first handle 58 and second handle 60. Handles can be separately formed and attached to the handle assembly or be formed integrally as part of the handle assembly. Optionally, first handle 58 and second handle 60 include handle apertures 62 (shown in ghost lines). Handle assembly 26 is configured to support the material weight stored in body 22, e.g., the weight of welding flux material, and to withstand forces applied to at least one of the opposing ends of handle assembly 26.

Illustrated in FIGS. 1-2, handle assembly 26 further includes optional first attachment tab 57 extending from first handle 58 and optional second attachment tab 59 extending from second handle 60. The attachment tabs span across at least a portion of the handle assembly. First attachment tab 57 and second attachment tab 59 are shown at the time of manufacture connected to body 22 or in-between use releasably connected to body 22. When the attachment tabs and/or the handles are released from the body, a person can adjustably position handle assembly 26 to carry container 20 and to dispense material from container 20. In the illustrated embodiments, first attachment tab 57 is heat sealed to first end 32 of body 22 and second attachment tab 59 is heat sealed to second wall 38 of body 22. Further, first handle 58 includes first tear strip 64 and second handle 60 includes a second tear strip 66 that each span laterally across at least a portion of width W3 of handle assembly 26. The tear strip can take the form of a perforation, string, or strip that may be pulled to separate a handle from the attachment tabs, the body or another part of the container. Therefore, first tear strip 64 and second tear strip 66 may be pulled, torn, or cut to release first handle 58 and second handle 60, respectively, from the heat sealed attachment tabs of handle assembly 26. In this embodiment, the attachment tabs remain secured to the body after the tear strips release the handles from the body. Alternatively, the attachment tabs may be connected to the body with a releasable adhesive, therefore, the container may not have tear strips. At least one portion of the handle assembly may be alternatively secured to at least one part of the container by connecting means such as, but not limited to, at least one of the following: a heat seal, a perforated seam, a permanent or releasable adhesive, a tear strip, and Velcro.

Additionally, at least one of the body, the panel, and the handle assembly may include reinforcements that can provide structural support and that may facilitate maintaining a particular container shape. It will be appreciated that the container, including the body, the panel, and the handle assembly, can be provided in any of a variety of suitable shapes and sizes. The container may also include lifting members, e.g., lifting loops, attached to the body or another part of the container.

In another aspect of the invention illustrated in FIGS. 1-3, the first end of first wall may join directly to the first end of second wall and/or the second end of first wall may join directly to the second end of second wall, i.e., the walls are joined by a heat seal and the container does not include the flat, laterally extending first and second ends illustrated in FIG. 1. In addition, a mechanical connection like a stitch or an adhesive, including but not limited to a hot melt glue or a water soluble cold glue, may join the ends of the walls.

In another optional aspect of the invention, the handle assembly may be configured as a continuous handle assembly 78, 79 that extends adjacent a perimeter of the body. The continuous handle assembly may have a unitary construction, e.g., a continuous loop, or may be joined together in at least one location, e.g., heat sealed in at least one location to form a continuous handle assembly. The continuous handle assembly includes handles that can be separately formed and attached to the handle assembly or be formed integrally as part of the handle assembly. Optionally, the continuous handle assembly includes at least one dispensing aperture that can be preformed or formed just prior to use of the container. When assembled with the container, the continuous handle assembly extends around the perimeter of the body, including within the space between the body and the first panel (discussed above) and optionally within another space formed between the body and the optional second panel. For example, the optional second panel may be securedly attached to an opposing side of the container relative to the first panel. Further, at least one panel optionally includes a handle that facilitates keeping the container in a desired position when carrying or dispensing the container.

Figure 4A:
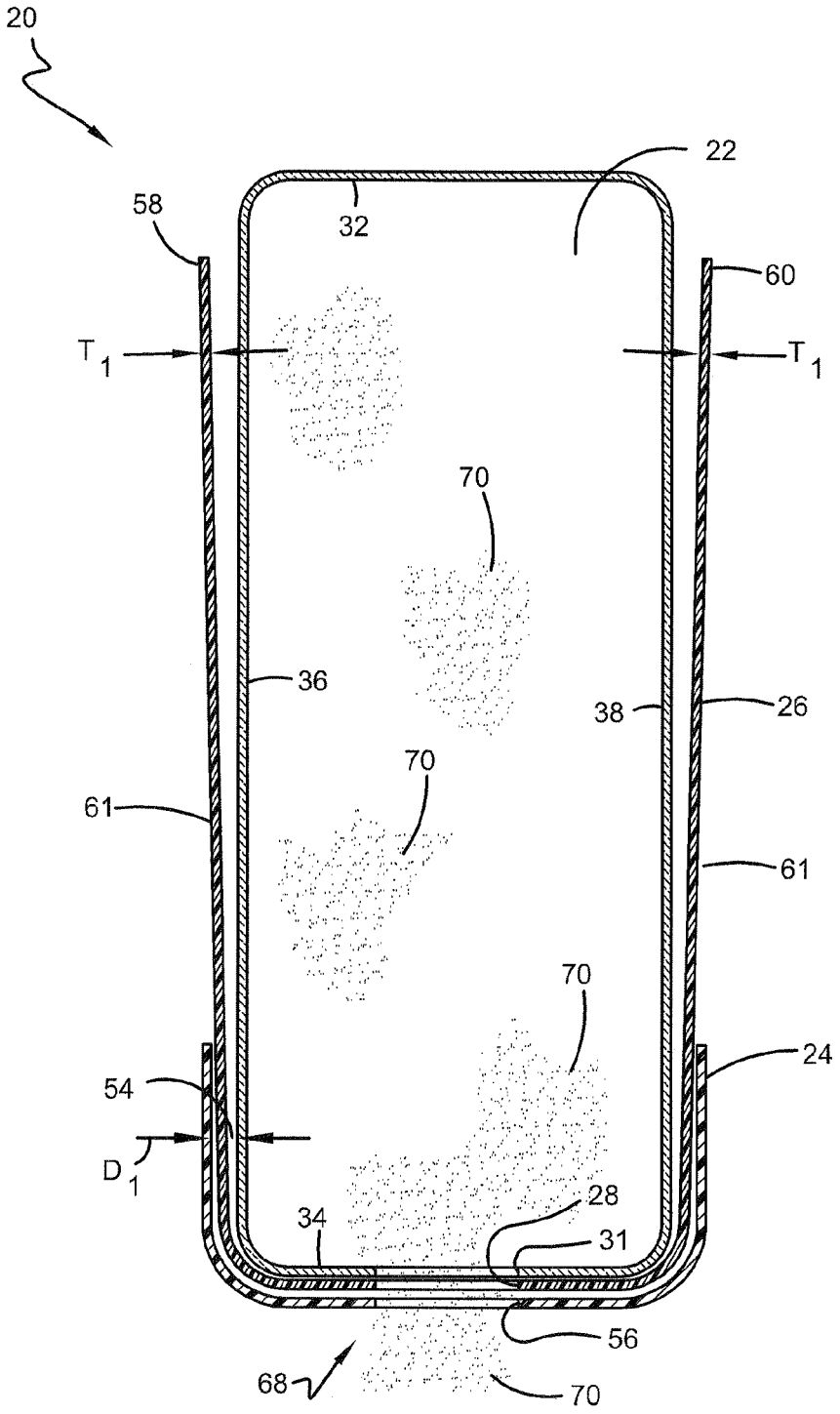
FIG. 4A is a cross-section view of the container taken along section 4-4 in FIGS. 1-2, wherein the ends of the handle assembly are detached from the container and material is dispensing from the container.
Figure 4B:
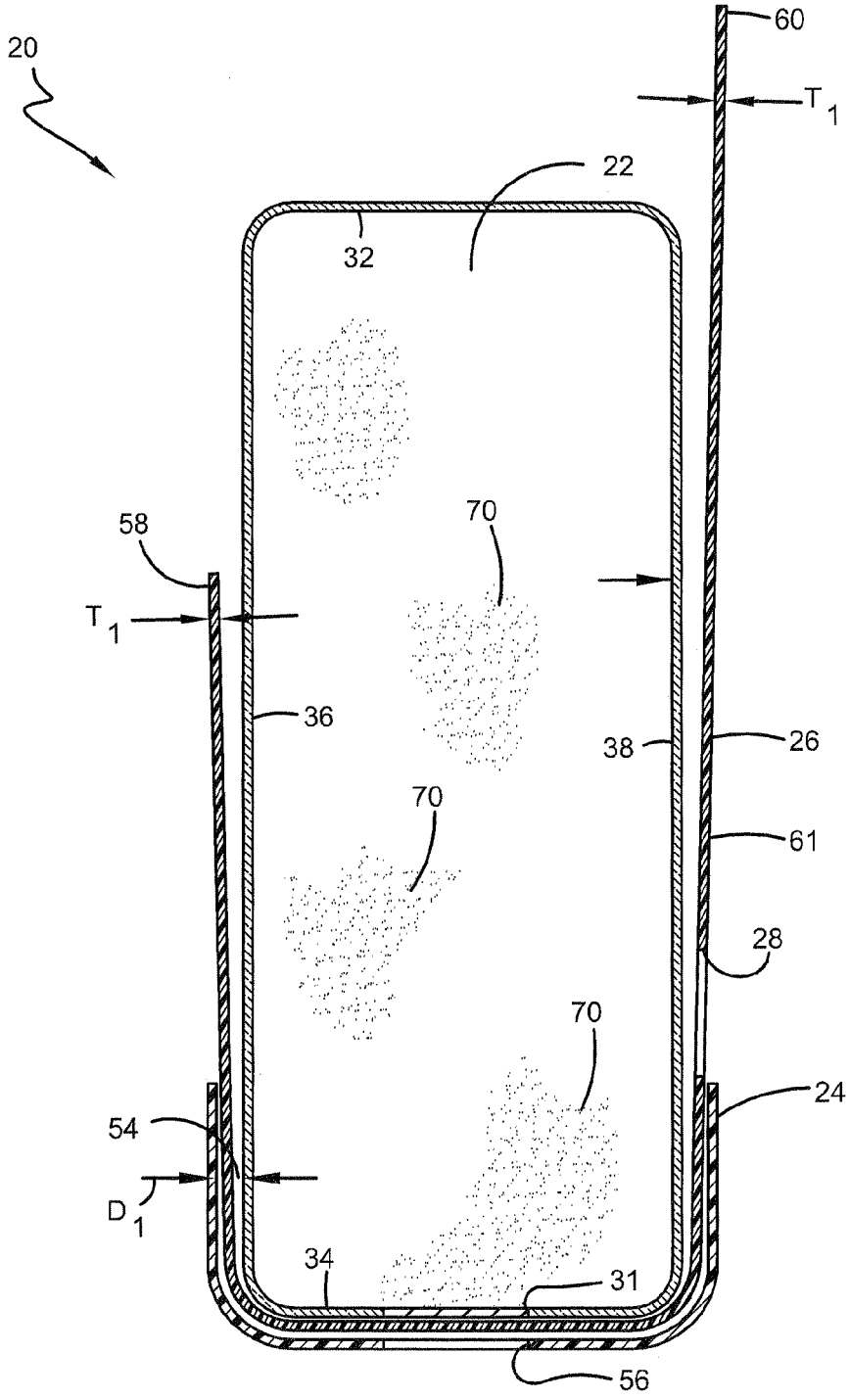
FIG. 4B is substantially similar to the cross-section view of FIG. 4A, with the handle assembly in an alternative position so that material cannot dispense from the container.

FIG. 4A is a cross-section view of container 20 taken along section 4-4 in FIG. 1 having handle assembly 26 disposed in space 54 between body 22 and panel 24, where first handle 58 and second handle 60 are detached from container 20 and held by a person (not shown) to facilitate transporting container 20 from one location to another. For dispensing, a user slidably moves handle assembly 26 and consequently dispensing aperture 28 to a position between body 22 and panel 24 where the user desires material to be dispensed from container 20. For example, opening 68 for dispensing material 70 from container 20 forms when there is at least partial alignment or overlap of dispensing aperture 28, body aperture 31, and panel aperture 56. In the illustrated embodiment, apertures 28, 31, and 56 are substantially aligned and material 70 dispenses from container 20.

Figure 5:
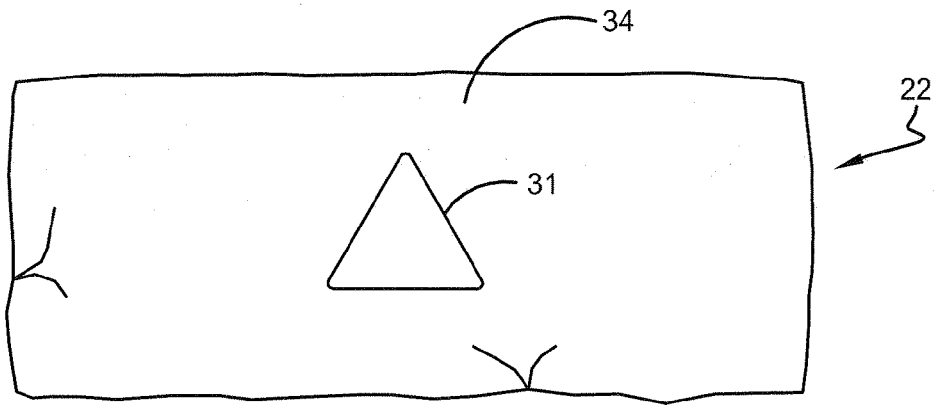
FIG. 5 is a bottom view of the body having a body aperture.
Figure 6:
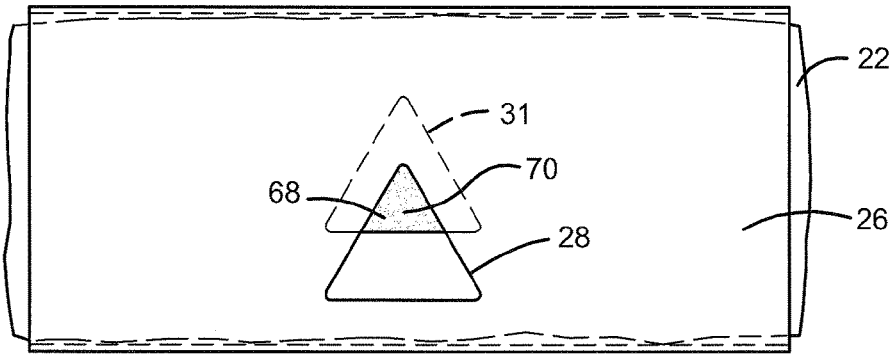
FIG. 6 is a bottom view of the body (partially illustrated in ghost lines) and the handle assembly, both having apertures, wherein the body aperture and the dispensing aperture are partially aligned.
Figure 7:
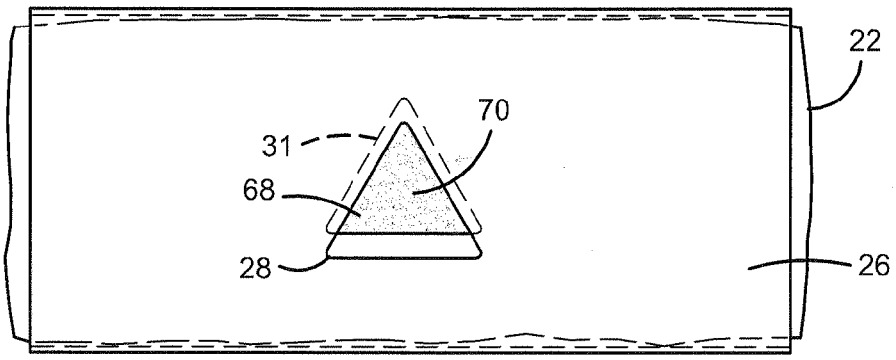
FIG. 7 is another bottom view of the body (partially illustrated in ghost lines) and the handle assembly, wherein the body aperture and the dispensing aperture are partially aligned to a greater degree relative to the alignment of the same illustrated in FIG. 6.

Dispensing aperture 28 is slidable relative to body aperture 31 and panel aperture 56, making the opening adjustable between one or more closed positions and one or more opened positions (see FIGS. 5-7). In the closed position, e.g., the position illustrated in FIG. 4B, dispensing aperture 28 does not align or overlap with the other apertures, therefore, handle assembly 26 substantially prevents dispensation of the material through body aperture 31 and panel aperture 56. In the open position, e.g., the position illustrated in FIG. 4A, dispensing aperture 28 can facilitate dispensation of material 70 sequentially through body aperture 31, dispensing aperture 28, and panel aperture 56. Slidable alignment of these apertures facilitates an infinitely variable rate of flow or dispensation of material 70 from container 20. In other words, the greater the alignment, the greater the flow. Alternatively, the dispensing aperture can be slidable among a plurality of predetermined positions or stops, each of which corresponds to a particular flow rate.

Optionally, first handle 58 and/or second handle 60 may be substantially aligned with indicator 67 (illustrated in FIGS. 2-3) marked on container 20 so a person holding container 20 knows a characteristic of the opening. For example, indicator 67 may specify that the position of the handles create an opening that is 50%, 75%, or 100% of a specified opening size or 50%, 75%, or 100% of a specified dispensing rate.

Further in FIG. 4A, handles 58 and 60 have a thickness T1, each handle thickness is configured so handle assembly 26 may be partially disposed in space 54 and slidably adjusted between body 22 and panel 24. A handle is defined to be any part of the handle assembly that a person can hold to facilitate movement of the handle assembly. In the illustrated embodiment, handles 58 and 60 and region 61 between the handles have thicknesses that are less than distance D1 of space 54 between body 22 and panel 24. For example, the thicknesses of the handles and the region between the handles can be any combination of thicknesses, including but not limited to equal or unequal thicknesses, where the thicknesses are less than the distance of the space between the body and the panel.

Alternatively, at least one handle or at least a portion of the region between the handles may have a thickness that is greater than the distance of the space between the panel and the body, therefore, movement of the handle assembly within the space may be limited. For example, the second handle may have a thickness that is slightly greater than the distance of the space, therefore, the second handle will not slidably move into the space. In addition, the thicknesses of the handles may be configured so that at least one handle may be partially disposed in the space between the body and the panel for storage purposes in-between uses of the container. The handle assembly may include a means for preventing at least one handle from passing into the space between the panel and the body, including: a spacer that limits movement of the handle assembly in the space between the body and the panel, the handle assembly may include a frictional material on at least one section that at least partially prevents movement between the handle assembly and the body and/or the panel, and at least one of the handles may include a non-planar shape, e.g., a corrugated shape that limits the handle assembly movement in the space between the body and the panel.

Referring to FIGS. 5-7, the container discussed herein may be adjustably opened and closed by at least partially aligning dispensing aperture 28 with body aperture 31 and/or panel aperture (the panel and the panel aperture are not shown for convenience of illustration in FIGS. 5-7). As illustrated in FIG. 5, body 22 includes body aperture 31. In FIG. 6, dispensing aperture 28 is shown partially aligned with body aperture 31 and forms opening 68 (indicated by the shaded overlap) in container 20. Further, dispensing aperture 28 and body aperture 31 are illustrated as having a greater partial alignment in FIG. 7, forming a larger opening 68 (relative to FIG. 6) in container 20. Therefore, FIGS. 6-7 illustrate an example of how handle assembly 26 can adjustably move relative to body 22 and the panel to form opening 68.

Dispensing aperture 28, body aperture 31, and panel aperture 56 can be configured to have alternative shapes, sizes, quantities, and/or patterns in various combinations. An aperture may be formed at the time of manufacture or subsequently, such as at the time of initial dispensing, to allow passage of material therethrough. Apertures may be fully formed or partially formed regions to facilitate later forming. At least one of the apertures may have at least one of the following shapes: triangular, circular, oval, square, rectangular, and other shapes known in the art. The dispensing aperture, the body aperture, and/or the panel aperture may include more than one aperture, have apertures of another size than what is illustrated in FIGS. 1-3, and/or have apertures with a pattern. For example, the handle assembly may have a group of apertures that include a pattern that ranges from a sparse pattern of apertures to a dense pattern of apertures. Optionally, the aperture(s) may further include a covering affixed about the aperture(s) by a pressure-sensitive adhesive. The pressure sensitive patch protects the aperture and may also be used to releasably secure one part of the container to another, e.g., a pressure sensitive patch protecting the dispensing aperture may be releasably secured to a perimeter of the handle assembly defining the dispensing aperture and the body to prevent movement therebetween.

Figure 8:
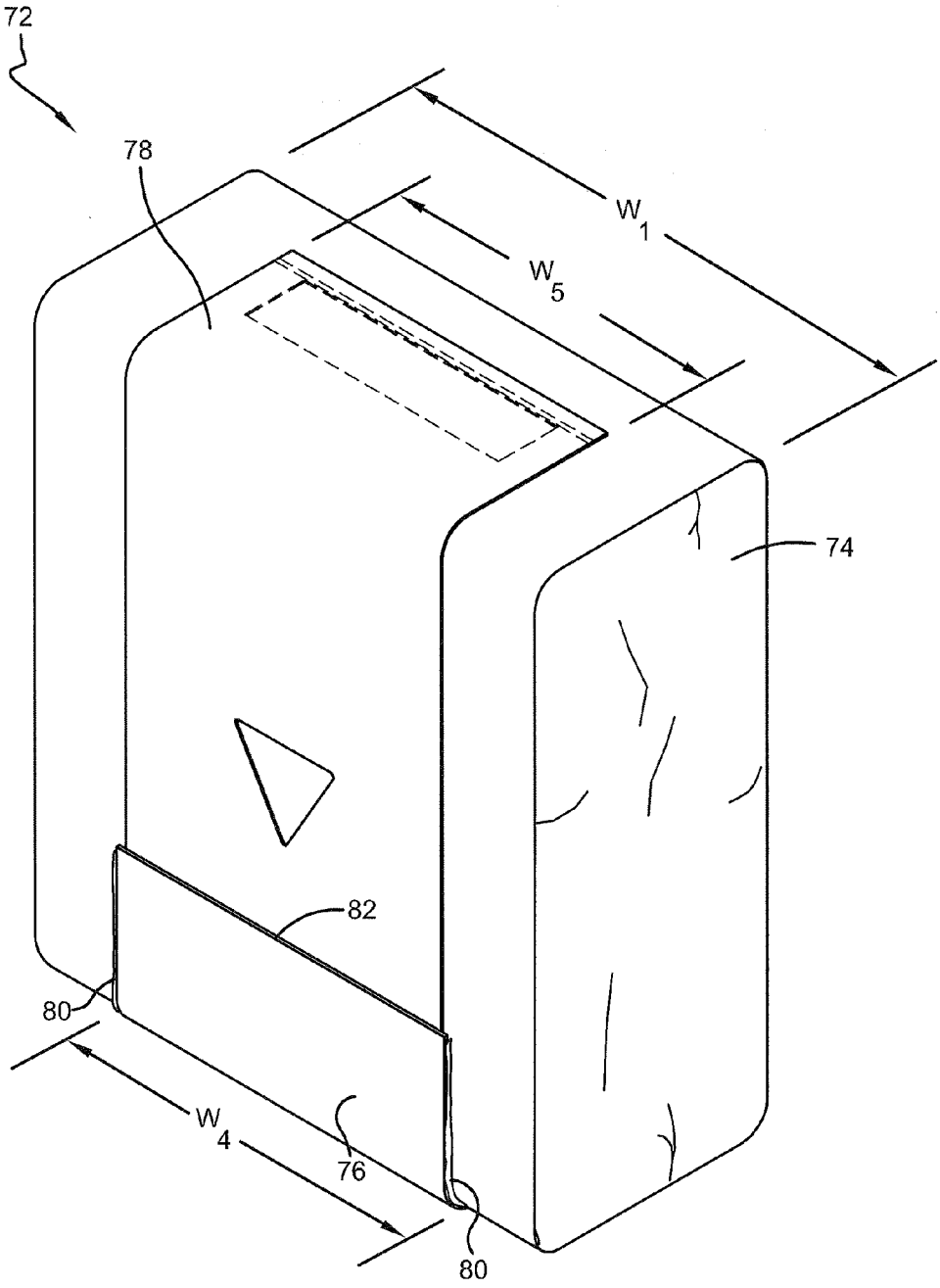
FIG. 8 is a top side perspective view of an alternative container having a handle assembly.
Figure 8A:
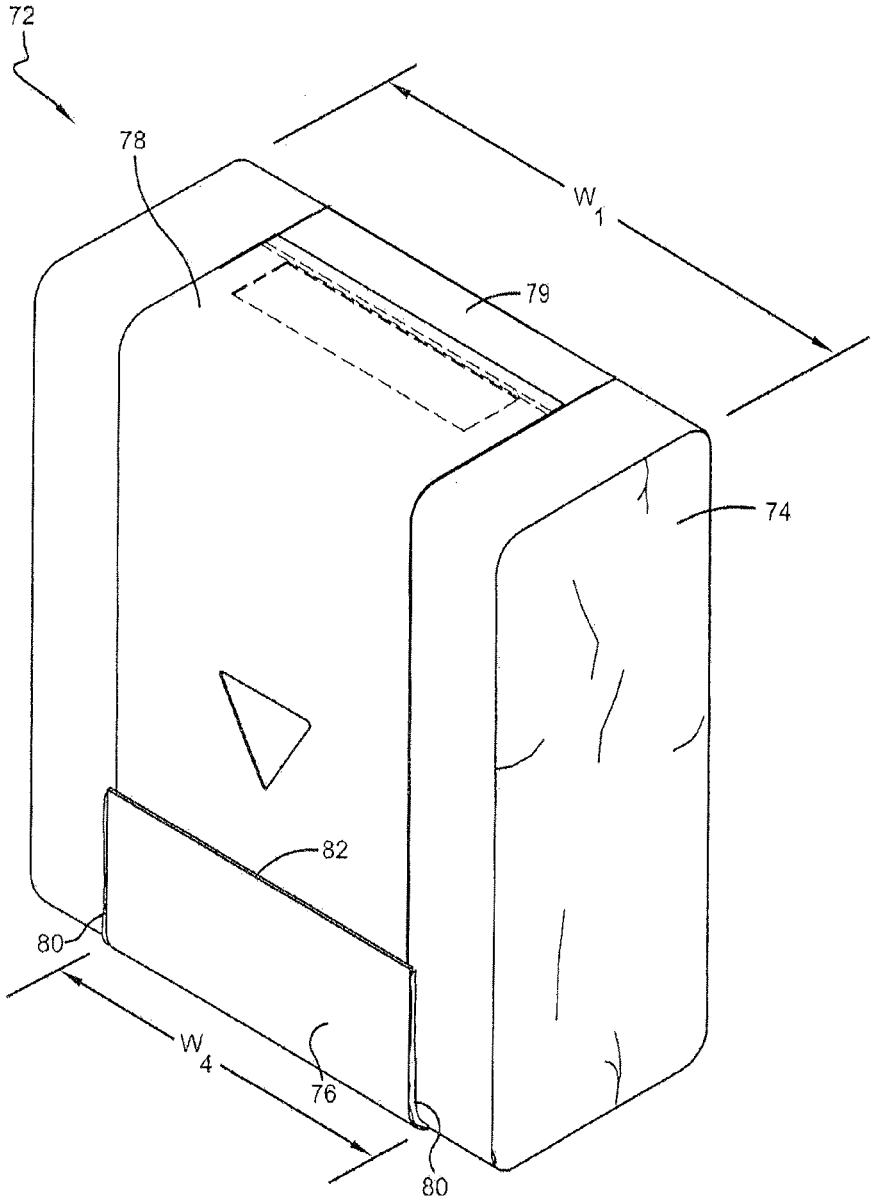
FIG. 8A is a top side perspective view of the alternative container of FIG. 8 illustrating a continuous handle assembly.

FIG. 8 illustrates a top side perspective view of an alternative container 72 that is similar to container 20, discussed above, including materials, construction, and container function, except container 72 includes an alternative panel 76 and handle assembly 78. Similar to container 20, panel 76 of container 72 is fixedly secured to body 74 by securing means 80 at two lateral ends of panel 76, and handle assembly 78 is at least partially disposed and slidable in space 82 between body 74 and panel 76. However, panel 76 has a width W4 and handle assembly 78 has a width W5 that are less than the width W1 of body 74. A handle assembly having a smaller width as illustrated in FIG. 8 may be used when the container is configured to hold a lower density material, for example. In addition, the container may include a second end reinforcement used in combination with the handle assembly to insure the second end maintains a desired shape. Alternatively, width W5 of handle assembly 78 may be a portion of width W4 of panel 76.

Figure 9:
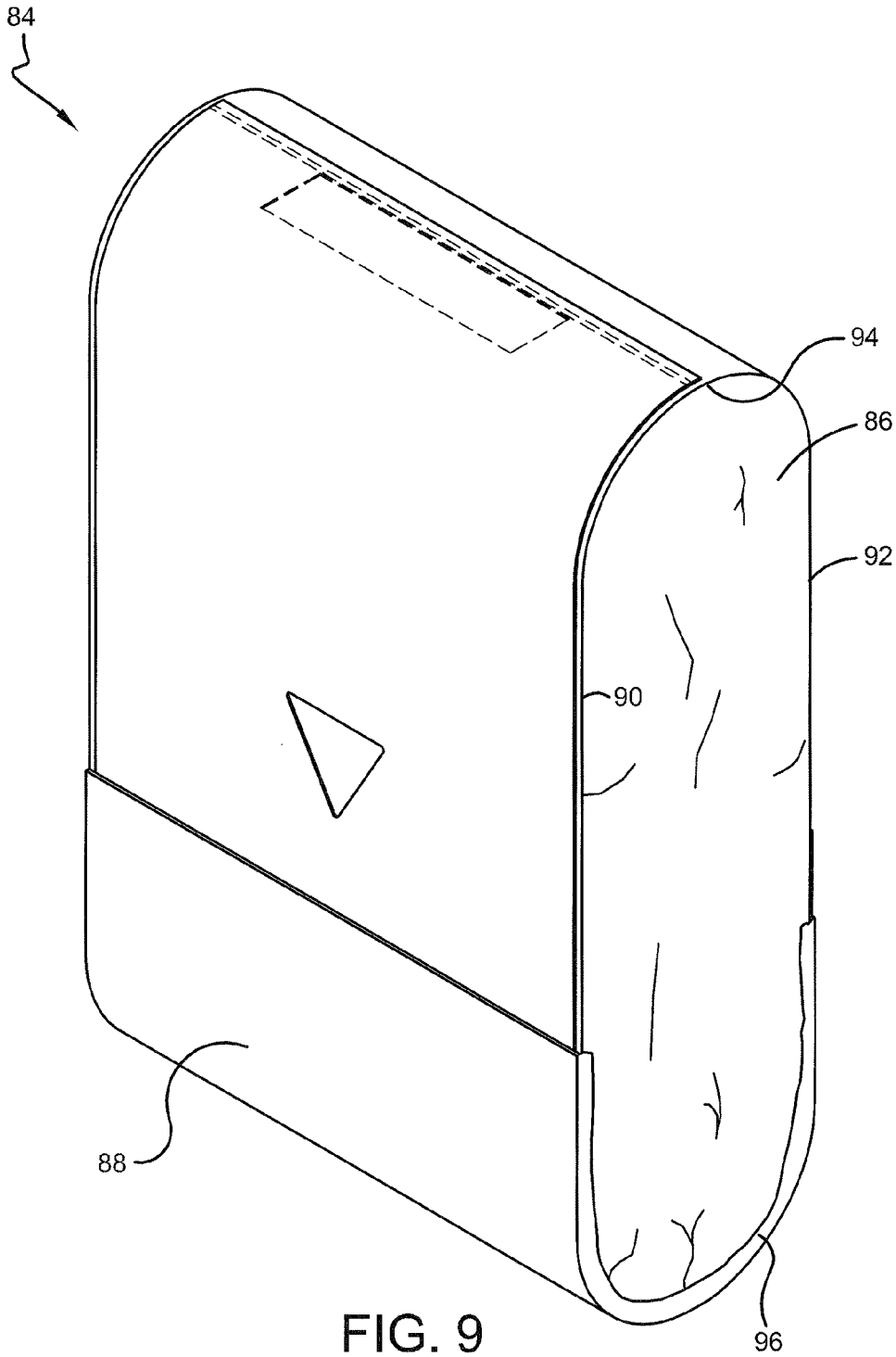
FIG. 9 is a top side perspective view of yet another alternative container having a handle assembly.

FIG. 9 illustrates a top side perspective view of yet another alternative container 84 that is similar to container 20 discussed above, including materials, construction, and container function, except container 84 includes an alternative body 86 and panel 88. Body 86 includes longitudinally extending walls 90 and 92 that each extend between first end 94 and second end 96. First end 94 and/or second end 96 have half-circle side profiles, therefore, panel 88 and/or the longitudinal ends of body 86 have substantially similar half-circle side profiles. The container shapes and profiles discussed herein are not intended to be limiting.

Figure 10:
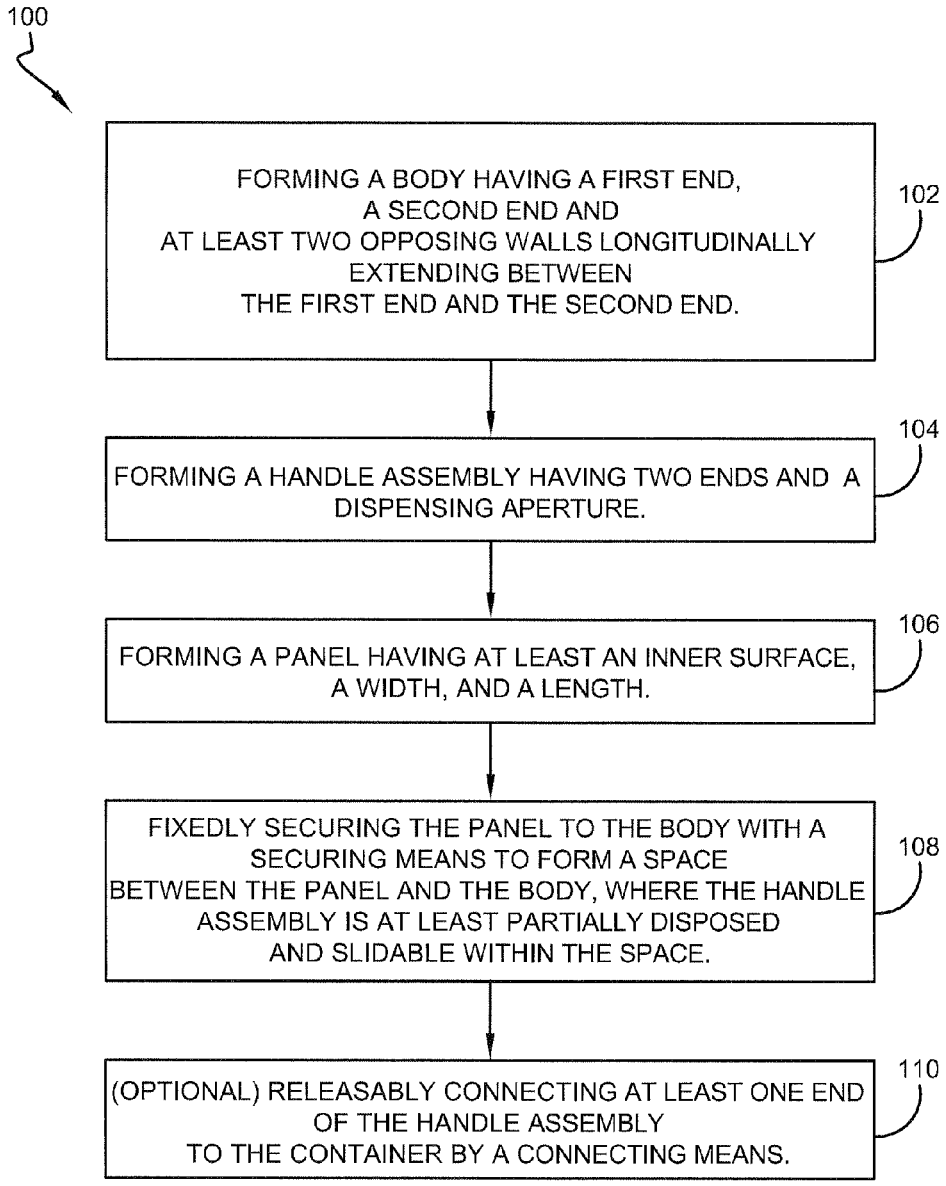
FIGS. 10-11 are flow charts illustrating methods of forming and using a container having a handle assembly.

FIG. 10 is a flow chart 100 illustrating one embodiment of a method of forming a container having a handle assembly. At 102, a body having a first end, a second end, and at least two opposing walls longitudinally extending between the first end and the second end is formed. At 104, a handle assembly having a dispensing aperture is formed and at 106 a panel having at least an inner surface, a width, and a length is formed. The panel is fixedly secured to the body with a securing means to form a space, where the handle assembly is at least partially disposed and slidable in the space at 108. Optionally at 110, at least one end of the handle assembly is releasably connected to the container by a connecting means. The connecting means may include a heat seal, a perforated seam, a tear strip, a releasable adhesive, and Velcro. Alternatively, the panel may have a panel aperture and/or the body may have a body aperture that are preformed or formed by the user.

Figure 11:
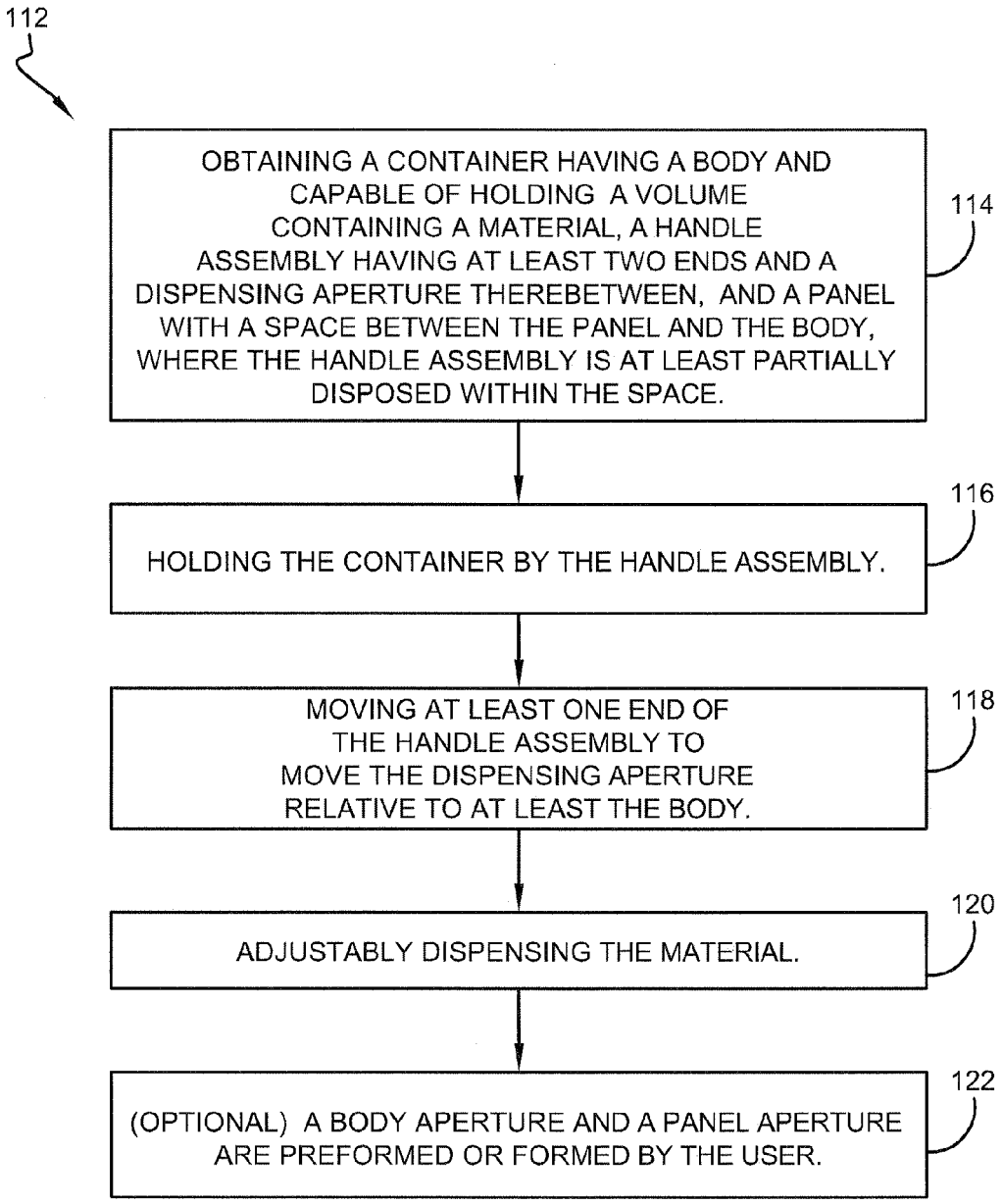

FIG. 11 is a flow chart 112 illustrating one embodiment of a method of dispensing material. At 114, a container including a body having a volume containing material, a panel, and a handle assembly having at least two ends and a dispensing aperture is obtained, where the handle assembly is partially disposed in a space between the body and the panel is obtained. At 116, the container is held by the handle assembly. At 118, at least one end of the handle assembly is moved so the dispensing aperture moves relative to at least the body and/or the panel. The material adjustably dispenses from the container at 120. At optional 122, a body aperture and/or a panel aperture are preformed or are formed by the user.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A container comprising:

a body having a first end, and a second end, a top and a bottom, each of said ends having a pair of edges extending from said bottom of said body to said top of said body, the body defining a closed volume of the container and further including at least two opposing walls having a width and longitudinally extending between the first end and the second end;

at least one panel having an outer surface, an inner surface, a width and a length, each side of said panel affixed to said first and second ends along said edges, said panel extending partway above said bottom of said body along said edges and which fixedly secures the at least one panel to the body, said at least one panel and said two opposing walls having a gap disposed therebetween; and a handle assembly disposed within said gap and having a pair of apertures at opposite ends of said handle assembly, said assembly having a length which surrounds said opposing walls from said bottom to a location proximate said top of said body, the handle assembly being slidable within the gap and the body, the at least one panel and the handle assembly each having an alignable dispensing means.

2. The container of claim 1, wherein the at least two opposing walls of the body are joined longitudinally, and joined laterally at the first end and the second end.

3. The container of claim 1, wherein at least one of the body, the at least one panel, and the handle assembly are made from at least one of the following materials: paper, plastic, foil plastic laminate, and textile.

4. The container of claim 1, wherein the body includes gusseted sidewalls.

5. The container of claim 1, wherein the dispensing means is selected from the group consisting of a body aperture, a panel aperture, and a dispensing aperture.

6. The container of claim 5, wherein at least partial alignment of the body aperture, the dispensing aperture, and the panel aperture form an opening in the container.

7. The container of claim 6, wherein movement of the dispensing aperture relative to the body aperture or the panel aperture adjusts a size of the opening.

8. The container of claim 5, wherein the body aperture, the dispensing aperture, and the panel aperture have substantially similar aperture shapes.

9. The container of claim 1, wherein the at least one panel includes a first end and a second end that span the width of the at least two opposing walls of the body.

10. The container of claim 1, wherein the securing means which fixedly secures the at least one panel to the body includes at least one of the following: adhesive, heat seal, edge-bonded, and stitching.

11. The container of claim 1, wherein the handle assembly includes a first handle and a second handle at opposing ends, the first handle and the second handle are configured to carry a weight of a material in the container.

12. The container of claim 1, wherein the handle assembly includes opposing ends that include attachment tabs and at least one attachment tab of the handle assembly is releasably connected to the container by a connecting means that includes at least one of the following: a heat seal, a perforated seam, a tear strip, a releasable adhesive, and Velcro.

13. The container of claim 12, wherein the at least one attachment tab of the handle assembly is releasably connected to at least one of the following: at least one wall of the at least two opposing walls of the body, the first end of the body, the second end of the body, the outer surface of the at least one panel, and the inner surface of the panel.

14. The container of claim 1, wherein the handle assembly is a continuous loop about a circumference of the body.

15. A container comprising:

a body having a first end, and a second end, a top and a bottom, a pair of opposing side walls, each of said ends having a pair of edges extending from said bottom of said body to said top of said body, the body defining a closed volume of the container and further including at least two opposing side walls longitudinally extending between the first end and the second end;

a panel having an outer surface, inner surface, a width and a length, each side of said panel affixed to said first and second ends along said edges, said panel extending partway above said bottom of said body along said edges and which fixedly secures the panel to the body, the panel and the two opposing walls having a gap disposed therebetween;

a handle assembly having a first handle and a second handle at opposing ends, the handle assembly disposed within said gap and having a pair of apertures as opposites ends of said handle assembly, the assembly having a length which surrounds said opposing walls from said bottom to a location proximate said top of said body, the handle assembly being slidable within the gap, at least one of said first and second handles of said handle assembly affixed to said top of said body while the other of said handles is affixed to one side of said body walls; and a means for preventing at least one handle from passing into the gap between the panel and the body; and a means for dispensing material from the container, including dispensing material through a body aperture, a panel aperture, and a handle assembly dispensing aperture, wherein the means for dispensing material from the container includes at least one of the following: at least one aperture is at least partially preformed before a material at least partially fills the container and at least one aperture is formed after the material at least partially fills the container.

16. The container of claim 15, wherein the means for preventing at least one handle from passing into the space between the panel and the body includes at least one of the following: at least one handle thickness is equal to or greater than the space between the panel and the body, at least one handle includes a non-planar surface that will not fit into the space, at least one handle includes a spacer attached to the at least one handle, and at least one handle includes a frictional material.

17. The container of claim 15, wherein at least one handle is partially disposed in the space.

18. The container of claim 15, wherein the first handle has a first handle thickness and the second handle has a second handle thickness, wherein the means for preventing at least one handle from passing into the space between the panel and the body includes at least one handle thickness, and wherein the first handle thickness and the second handle thickness are unequal.

19. The container of claim 15, wherein the handle assembly dispensing aperture is preformed.

20. The container of claim 15, wherein at least one end of the handle assembly is releasably connected to the container by a connecting means that includes at least one of the following: a heat seal, a perforated seam, a tear strip, a releasable adhesive, and Velcro.

21. A method of forming a container comprising:

forming a body having a first top end, and a second bottom end and further including at least two opposing walls longitudinally extending between the first top end and the second bottom end, the at least two opposing walls joined longitudinally, and joined laterally at least at the second bottom end;

forming a handle assembly having two ends and a dispensing aperture, said handle assembly dimensioned to wrap about at least about one opposing wall, said bottom end and at least partially about a top end and said other opposing wall of said body;

forming a panel having an outer surface, an inner surface, a width and a length; and fixedly securing the panel to the body with a securing means to form a gap between the panel and the body, wherein the handle assembly is disposed within the space; and attaching said handle assembly to either a top or one opposing wall of said body.

22. The method of claim 21 further comprising releasably connecting at least one end of the handle assembly to the container by a connecting means that includes at least one of the following: a heat seal, a perforated seam, a tear strip, a releasable adhesive, and Velcro.

23. The method of claim 21, wherein the container further includes at least one of the following: the body includes a body aperture and the panel includes a panel aperture that are preformed.

24. The method of claim 21, wherein the container further includes at least one of the following: the body includes a body aperture and the panel includes a panel aperture that are formed by a user.

* * * * *